US007508139B2

(12) United States Patent
Kwon

(10) Patent No.: US 7,508,139 B2
(45) Date of Patent: Mar. 24, 2009

(54) PLASMA DISPLAY PANEL HAVING A RESISTIVE ELEMENT

(75) Inventor: Jae-Ik Kwon, Asan-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 502 days.

(21) Appl. No.: 11/089,532

(22) Filed: Mar. 25, 2005

(65) Prior Publication Data

US 2005/0236988 A1 Oct. 27, 2005

(30) Foreign Application Priority Data

Apr. 12, 2004 (KR) ..... 10-2004-0024892

(51) Int. Cl.
*H01J 17/49* (2006.01)

(52) U.S. Cl. ..... 313/586; 313/582

(58) Field of Classification Search ..... 313/582–587
See application file for complete search history.

(56) References Cited

U.S. PATENT DOCUMENTS

| | | | | |
|---|---|---|---|---|
| 5,420,601 | A * | 5/1995 | Amano | 345/60 |
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,744,909 | A * | 4/1998 | Amano | 313/585 |
| 5,786,794 | A | 7/1998 | Kishi et al. | |
| 5,952,782 | A | 9/1999 | Nanto | |
| 6,195,075 | B1 * | 2/2001 | Shino et al. | 345/68 |
| RE37,444 | E | 11/2001 | Kanazawa | |
| 6,630,916 | B1 | 10/2003 | Shinoda | |
| 6,707,436 | B2 | 3/2004 | Setoguchi et al. | |

(Continued)

FOREIGN PATENT DOCUMENTS

| | | |
|---|---|---|
| JP | 02-148645 | 6/1990 |

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Toan Ton
*Assistant Examiner*—Britt Hanley
(74) *Attorney, Agent, or Firm*—Robert E. Bushnell, Esq.

(57) ABSTRACT

A novel design for a plasma display panel where a dielectric grid structure is formed between the front and the rear substrate. Some or all of the electrodes are formed within the dielectric grid structure. The electrodes surround individual discharge cells and thus produce a more efficient discharge. A resistive element is built into the electrodes to reduce current and to reduce power consumption. The sustain discharge electrodes, made of X and Y electrodes each are made of at least two separate electrode lines, all four electrodes being formed within the dielectric grid. By such a design, power consumption is reduced and light emission efficiency is improved.

39 Claims, 8 Drawing Sheets

U.S. PATENT DOCUMENTS

| | | | | |
|---|---|---|---|---|
| 6,903,711 | B2 * | 6/2005 | Akiba | 345/67 |
| 7,015,643 | B2 * | 3/2006 | Kweon | 313/583 |
| 7,067,978 | B2 * | 6/2006 | Kwon et al. | 313/582 |
| 7,196,470 | B2 * | 3/2007 | Yoo et al. | 313/582 |
| 7,221,097 | B2 * | 5/2007 | Kweon | 313/583 |
| 7,256,545 | B2 * | 8/2007 | Woo et al. | 313/582 |
| 7,279,837 | B2 * | 10/2007 | Kwon et al. | 313/583 |
| 7,327,084 | B2 * | 2/2008 | Yoo et al. | 313/587 |
| 7,365,491 | B2 * | 4/2008 | Kang et al. | 313/583 |
| 7,408,301 | B2 * | 8/2008 | Kwon et al. | 313/582 |
| 2002/0130619 | A1 * | 9/2002 | Mori et al. | 313/585 |
| 2005/0093444 | A1 * | 5/2005 | Woo et al. | 313/582 |
| 2005/0116646 | A1 * | 6/2005 | Yoo et al. | 313/582 |
| 2005/0212423 | A1 * | 9/2005 | Kwon et al. | 313/582 |
| 2008/0018562 | A1 * | 1/2008 | Jung et al. | 345/60 |

FOREIGN PATENT DOCUMENTS

| | | |
|---|---|---|
| JP | 10-208646 | 8/1998 |
| JP | 2845183 | 10/1998 |
| JP | 2917279 | 4/1999 |
| JP | 2001-043804 | 2/2001 |
| JP | 2001-325888 | 11/2001 |
| JP | 2002-184318 | 6/2002 |
| JP | 2004-039601 | 2/2004 |

OTHER PUBLICATIONS

U.S. Patent Application Serial No.—to be assigned—to Jae-Ik Kwon et al., entitled Plasma Display Panel, which is concurrently filed with this application.

* cited by examiner

PLASMA DISPLAY PANEL HAVING A RESISTIVE ELEMENT

CLAIM OF PRIORITY

This application makes reference to, incorporates the same herein, and claims all benefits accruing under 35 U.S.C. §119 from an application earlier filed in the Korean Intellectual Property Office on 12 Apr. 2004 and there duly assigned Serial No. 10-2004-0024892.

BACKGROUND OF THE INVENTION

1. Field of the Invention

The present invention relates to a plasma display panel, and more particularly, to a design for a plasma display panel that can improve light emission efficiency while lowering power consumption by placing the discharge electrodes around individual discharge cells and mounting a resistive element on the discharge electrodes that are used to initiate discharge.

2. Description of the Related Art

A plasma display panel (PDP) is a flat panel display device that displays characters and images. A potential difference is applied to electrodes causing an electric field in a discharge cell that produces a plasma. The plasma generates ultra violet radiation that excites a fluorescent layer in the discharge cell to produce visible images.

A surface discharge type PDP includes discharge sustaining electrode pairs that include X and Y electrodes formed on an inner surface of a front substrate, a front dielectric layer that covers the discharge sustaining electrode pairs and a protection film coated over the front dielectric layer. Also, address electrodes run in a direction that crosses over the discharge sustaining electrode pairs. A rear dielectric layer covers the address electrodes, barrier ribs are formed on the rear dielectric layer and fluorescent layers of red, green, and blue are coated on the walls of the barrier ribs and on the inner surface of the rear dielectric layer. When the front substrate and the rear substrate are coupled together, discharge cells are formed. These discharge cells are filled with an inert plasma gas.

To drive a PDP having the above structure, discharge cells are selected by applying electrical signals to a Y electrode and an address electrode that cross at the selected discharge cell. Then, electrical signals are alternately applied to the X and Y electrodes thus producing the plasma and the ultraviolet radiation. The ultraviolet radiation then excites fluorescent layers in the discharge cell to produce red, green and blue visible light.

Japanese Patent Laid-Open No. 2004-39601 discloses a structure with improved light emission efficiency, in which scan electrodes are coated with a thin dielectric layer, sustaining electrodes are coated with a thick dielectric layer, and address electrodes are coated with a thick dielectric layer. Japanese Patent Laid-Open No. 2002-184318 discloses a structure of a main electrode for improved brightness, in which main discharging is induced at a reduced discharge current. Japanese Patent Laid-Open No. 1999-344936 discloses a structure that does not require chip resistance for controlling a current input to a PDP. Japanese Patent Laid-Open No. 1998-208646 discloses a structure that can control the reduction of sustaining discharge voltage margin due to non-uniform thickness of a dielectric layer.

However, a surface discharge PDP is a display device using discharge initiation and diffusion in a discharge gap between discharge sustaining electrodes. In this structure of a PDP, brightness depends on how transparent the front substrate is to visible light generated from the excitation of the fluorescent layer by ultra violet rays generated through discharge in a discharge cell. Therefore, the surface discharge PDP has the following drawbacks. First, the transmittance of visible light is less than 60% since the discharge sustaining electrode pair, the front dielectric layer, and the protection film are all formed on an inner surface of the front substrate and the visible light is required to go through or around all of these elements. Second, light emission efficiency is low since the discharge sustaining electrode pair is formed on an inner surface of the front substrate, which is on the very top of the discharge space. Thus, these electrodes block light and hinder light transmission through the front substrate. Also, these electrodes are far from the address electrodes producing a less than optimized discharge. What is therefore needed is an improved design for a PDP that doesn't block the transmittance of visible light through the front substrate while allowing for an efficient discharge to take place, with less power consumption and improved light emission efficiency.

SUMMARY OF THE INVENTION

It is therefore an object of the present invention to provide an improved design for a PDP.

It is also an object of the present invention to provide an improved electrode design for a PDP.

It is still an object of the present invention to provide a design for a PDP that improves visible light transmittance through the front substrate.

It is also an object of the present invention to provide a design for a PDP that produces an efficient discharge.

It is further an object of the present invention to provide a design for a PDP that improves the aperture ratio.

It is still an object of the present invention to provide a design for a PDP that improves light emission efficiency.

It is further an object of the present invention to provide a design for a PDP that reduces power consumption.

It is also an object of the present invention to provide a design for a PDP that prevents the occurrence of a latent image caused by sputtering of a fluorescent layer by the plasma.

These and other objects can be achieved by a PDP where the discharge sustaining electrode pairs extend around a discharge space. Further, a resistive element is connected in series to electrode elements.

According to an aspect of the present invention, there is provided a PDP that includes a front substrate and a rear substrate facing the front substrate, a dielectric grid defining discharge cells together with the front substrate and the rear substrate and located between the front substrate and the rear substrate, an X electrode buried within the dielectric grid and made out of a first X electrode and a second X electrode placed separately around the discharge cell, a Y electrode also buried within the dielectric grid and having a first Y electrode and a second Y electrode placed separately around the discharge cell, a resistive element connected to at least one of the X and Y electrodes to reduce a discharge current when discharging occurs, and a plurality of fluorescent layers of red, green, and blue formed within the discharge cell.

According to embodiments of the PDP, the X electrode extends in a direction parallel to the substrates and includes a first X electrode and a second X electrode that exist on different planes from each other. The first X electrode is closer to the front substrate than the second X electrode and the second X electrode is closer to the rear substrate than the first X electrode. The first X electrode and the second X electrode are separately arranged around the discharge cells and are electrically connected to each other in an edge portion of the display. The Y electrode also extends in a direction parallel to the substrates and includes a first Y electrode and a second Y electrode that exist on different planes from each other. The first Y electrode is closer to the front substrate than the second Y electrode and the second Y electrode is closer to the rear substrate than the first Y electrode. The first Y electrode and the second Y electrode are separately arranged around the discharge cells and are electrically connected to each other in an edge portion of the display.

The resistive element is connected to at least one of the X electrode and the Y electrode where the discharge is initiated. The resistive element is located at an edge of the display area and where the first and the second X or Y electrodes are connected to each other.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
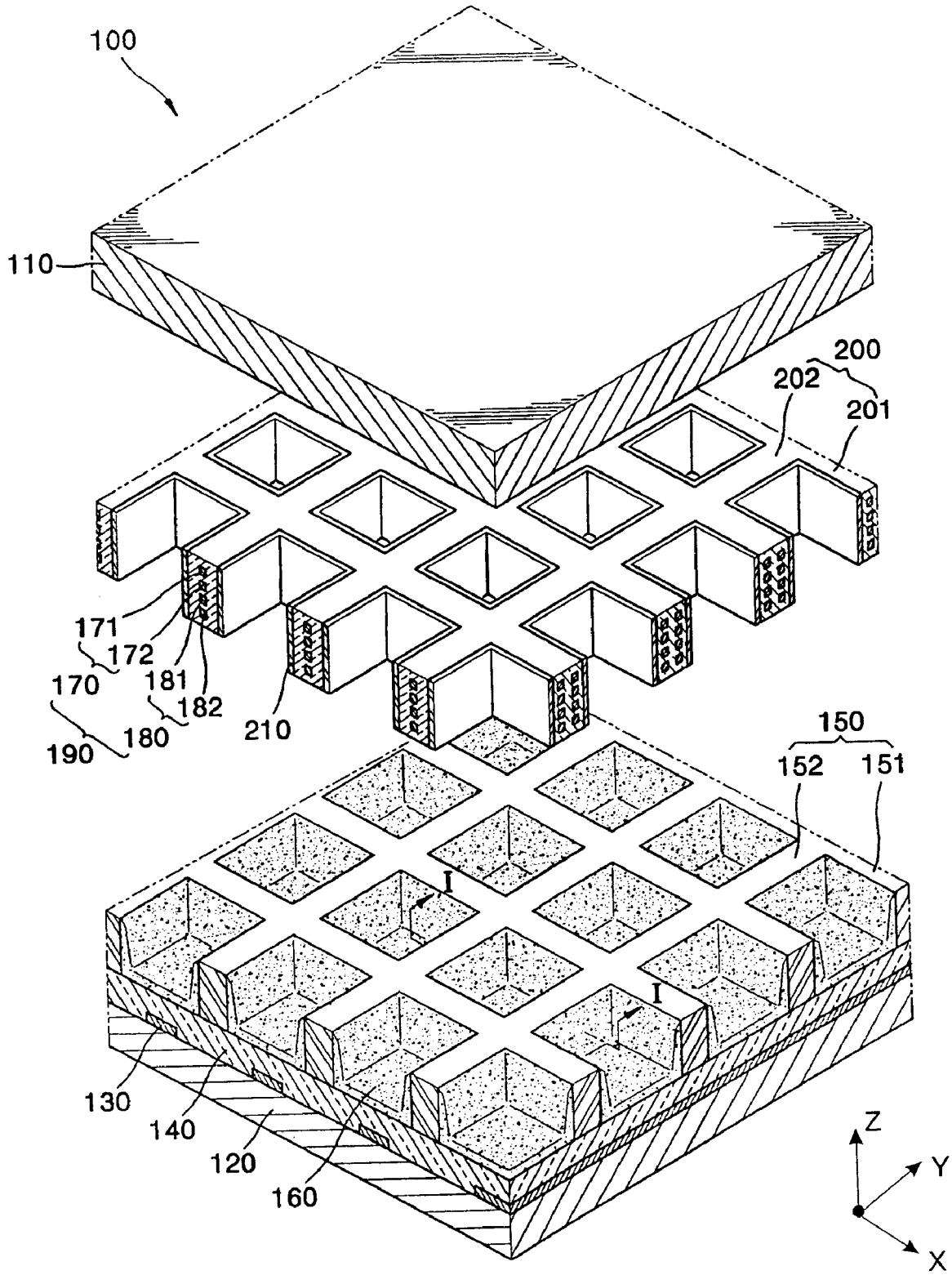
FIG. 1 is a partial cut away exploded perspective view illustrating a PDP according to an embodiment of the present invention.
Figure 2:
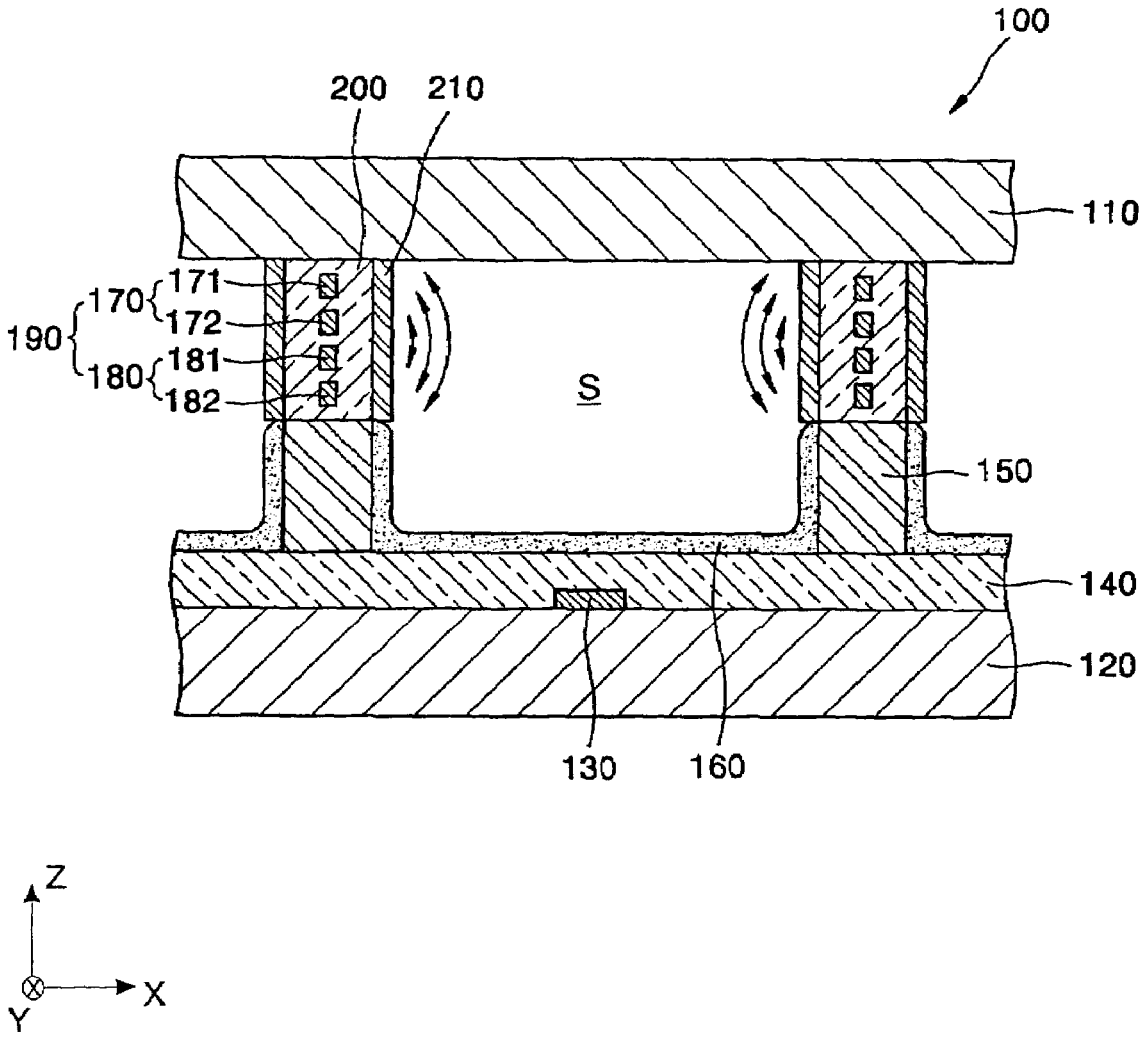
FIG. 2 is cross-sectional view taken along line I-I of FIG. 1 when the PDP is coupled.

Turning now to the figures, FIG. 1 is a partial cut-away exploded perspective view of a PDP 100 according to an embodiment of the present invention and FIG. 2 is cross-sectional view taken along line I-I of FIG. 1 when the PDP 100 is coupled. Referring to FIGS. 1 and 2, a PDP 100 includes a front substrate 110 and a rear substrate 120 arranged parallel to the front substrate 110. Frit glass is coated at edges of the inner surfaces of the front substrate 110 and the rear substrate. The frit glass seals a space from the outside by sealing the front substrate 110 to the rear substrate 120.

The front substrate 110 is made of a transparent substrate such as soda lime glass. The rear substrate 120 is essentially formed of the same material as the front substrate 110. A dielectric grid 200 that defines discharge cells is sandwiched (e.g., interposed) in between the front and rear substrate 110 and 120. The dielectric grid 200 is made of a glass paste combined with various fillers.

The dielectric grid 200 includes a first dielectric grid member 201 extending in the x direction and a second dielectric grid member 202 extending in the y direction between the front and rear substrates 110 and 120. The second dielectric grid member 202 extends preferably orthogonal to and intersects with the first dielectric grid members 201. The coupled first dielectric grid member 201 and the second dielectric grid member 202 forms a matrix resulting in a rectangularly shaped dielectric grid 200 and rectangularly shaped discharge cells.

Alternatively, the dielectric grid 200 can be designed to have other shapes, such as a meander type, a delta type, or a honeycomb type. Also, the discharge cells defined by the dielectric grid 200 can be formed in various shapes besides the rectangular shape, such as a hexagon, an oval, or a circle, and the structure of the dielectric grid and the discharge cells of the present invention is not limited thereto.

An X electrode 170 and a Y electrode 180 are buried within the dielectric grid 200. The X and Y electrodes 170 and 180 are also formed around the discharge cells. The X and Y electrodes 170 and 180 are electrically isolated from each other and are thus held at different potentials. The side walls of the dielectric grid 200 are covered and protected by a protection film 210 such as magnesium oxide (MgO). The protection film 210 protects the sidewalls from ion sputtering caused by the plasma and enables the side walls of the discharge cells to emit secondary electrons by the reaction with the inner surface of the dielectric grid 200.

Barrier ribs 150 can further be formed between the dielectric grid 200 and the rear substrate 120. The barrier ribs 150, unlike the dielectric grid 200, are formed of a material having a low dielectric constant. The material that makes up the barrier ribs 150 preferably has a lower dielectric constant than the material used to make the dielectric grid 200. The barrier ribs 150 essentially have the same shape and the same pattern as the dielectric grid 200 and are arranged to correspond to the dielectric grid 200.

The barrier ribs 150 include a first barrier rib 151 extending parallel to the first dielectric grid member 201 and a second barrier ribs 152 extending parallel to the second dielectric grid member 202. The first and second barrier ribs 151 and 152 form a matrix by coupling with each other to form one body.

If the PDP is designed without the barrier ribs, then only the dielectric grid 200 is formed between the front and rear substrate 110 and 120, and only this single wall having a single material defines the discharge cells. When the dielectric grid 200 together with the barrier ribs 150 are formed between the front and rear substrate 110 and 120, the structure defining the discharge cells is a double layered structure, each layer having different dielectric constants.

An address electrode 130 extends in a direction that crosses the X and Y electrodes 170 and 180. The address electrode 130 may be formed on an upper surface of the rear substrate 120. The address electrode 130 is located near the discharge cell S and is covered by rear dielectric layer 140.

The PDP 100 can be designed in various types according to types of discharge, such as a surface discharge type, a facing discharge type, or a hybrid type. In the present invention, the X and Y electrodes 170 and 180 form a sustaining electrode pair 190 that generates a display sustaining discharge, and the address electrode 130 is an electrode that generates an addressing discharge by extending in an intersecting direction with the sustaining electrode pair 190. Alternatively, the address electrode 130 can be formed within the dielectric grid 200 instead of on the rear substrate 120. A discharge gas, such as Ne—Xe, or He—Xe, fills the discharge cell S defined by the front and rear substrate 110 and 120, the dielectric grid 200 and the barrier ribs 150.

Fluorescent layers 160 of red, green, and blue that generate visible light when excited by ultra violet rays generated from the discharge gas are formed in the discharge cell. The fluorescent layers 160 can be coated on any surface within the discharge cell, but in the present embodiment, the fluorescent layers 160 are preferably coated at a predetermined thickness on sidewalls of the barrier ribs 150 and on the upper surface of the rear dielectric layer 140. The fluorescent layers 160 of red, green, and blue are coated in each discharge cell. The red fluorescent layer may be made of $(Y,Gd)BO_3:Eu^{+3}$, the green fluorescent layer may be made of $Zn_2SiO_4:Mn^{2+}$, and the blue fluorescent layer may be made of $BaMgAl_{10}O_{17}:Eu^{2+}$.

Here, the X and Y electrodes 170 and 180 are formed of at least two electrodes, and at least one resistive element is included in one of the X and Y electrodes 170 and 180. More specifically, the X electrode 170 includes at least two electrodes, and the Y electrode 180 also includes at least two electrodes.

The X electrode 170 extends in an x direction and parallel to the front substrate 110. As illustrated in the figures, the X electrode 170 includes a first X electrode 171 and a second X electrode 172 located below the first X electrode 171. The first X electrode 171 and the second X electrode 172 are formed on different planes (i.e., spaced apart in the z direction) from each other. The first X electrode 171 is positioned closer to the front substrate 110 than the second X electrode 172, and the second X electrode 172 is positioned closer to the rear substrate 120 than the first X electrode 171. The first X electrode 171 and the second X electrode 172 are positioned apart from each other and positioned around the discharge cell and are electrically connected to each other in an edge region of the display as will be described with reference to FIGS. 3 though 5.

The Y electrode 180 is positioned below (i.e., closer to the rear substrate 120) the X electrode 170 and is aligned with the X electrode 170. The Y electrode 180 is extends around the discharge cell and has a ladder shape extending around consecutive and adjacent discharge cells in an x direction and parallel to the front substrate 110. The Y electrode 180, like the X electrode 170, surrounds and has the same essential shape as the discharge cell S, i.e. a rectangular shape although in no way is the present invention so limited. The X and Y electrodes 170 and 180 are connected to external terminals in the non-display region ND at the edge of the PDP 100.

By having each of the electrodes of the sustaining electrode pair 190 formed around the discharge cell S as opposed to above the discharge cell, light generated in the discharge cell S is not obstructed by any of the sustaining electrode pair electrodes when the light tries to leave the PDP by going through the front substrate 110. This improves the light emission efficiency and improves the aperture ratio for the display since light generated from the discharge cell S is not blocked by electrodes formed on the front substrate directly over phosphor material in the discharge cell.

The Y electrode 180 includes a first Y electrode 181 and a second Y electrode 182 located below (i.e., in the −z direction from) the first Y electrode 181. The first Y electrode 181 and the second Y electrode 182 are located on different planes from each other (i.e., spaced apart from each other in the z direction). The first Y electrode 181 is positioned closer to the front substrate 110 than the second Y electrode 182, and the second Y electrode 182 is positioned closer to the rear substrate 120 than the first Y electrode 181. The first Y electrode 181 and the second Y electrode 182 are positioned apart from each other and surround the discharge cell and are electrically connected to each other in an edge region of the display (i.e. the non-display or ND region).

Figure 3:
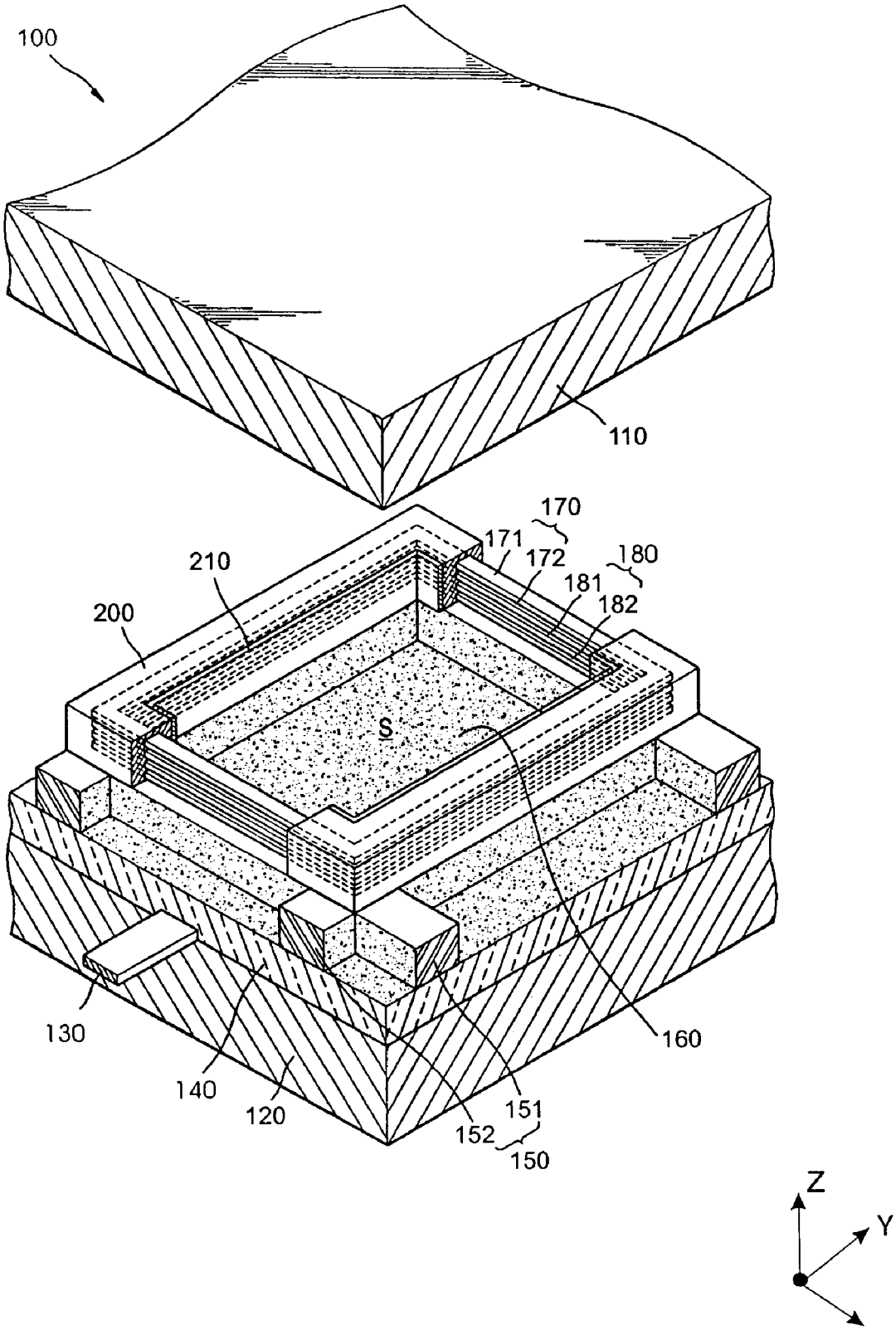
FIG. 3 is a partial cut away exploded perspective view of a single discharge cell S of the PDP illustrated in FIGS. 1 and 2.

Turning to FIG. 3, FIG. 3 is a partial cut away exploded perspective view illustrating a single discharge cell S of the PDP 100 of FIGS. 1 and 2. As can be seen in FIG. 3, each of the electrodes 171, 172, 181 and 182 surround the discharge cell S. The barrier ribs 150 and the dielectric grid 200 form coincident patterns of a rectangle and are formed around the edges of discharge cell S. The phosphor layer 160 is in a lower portion of the discharge cell S separate and apart from the electrodes 171, 172, 181 and 182 and is thus protected from ion sputtering when a plasma is generated.

Figure 4:
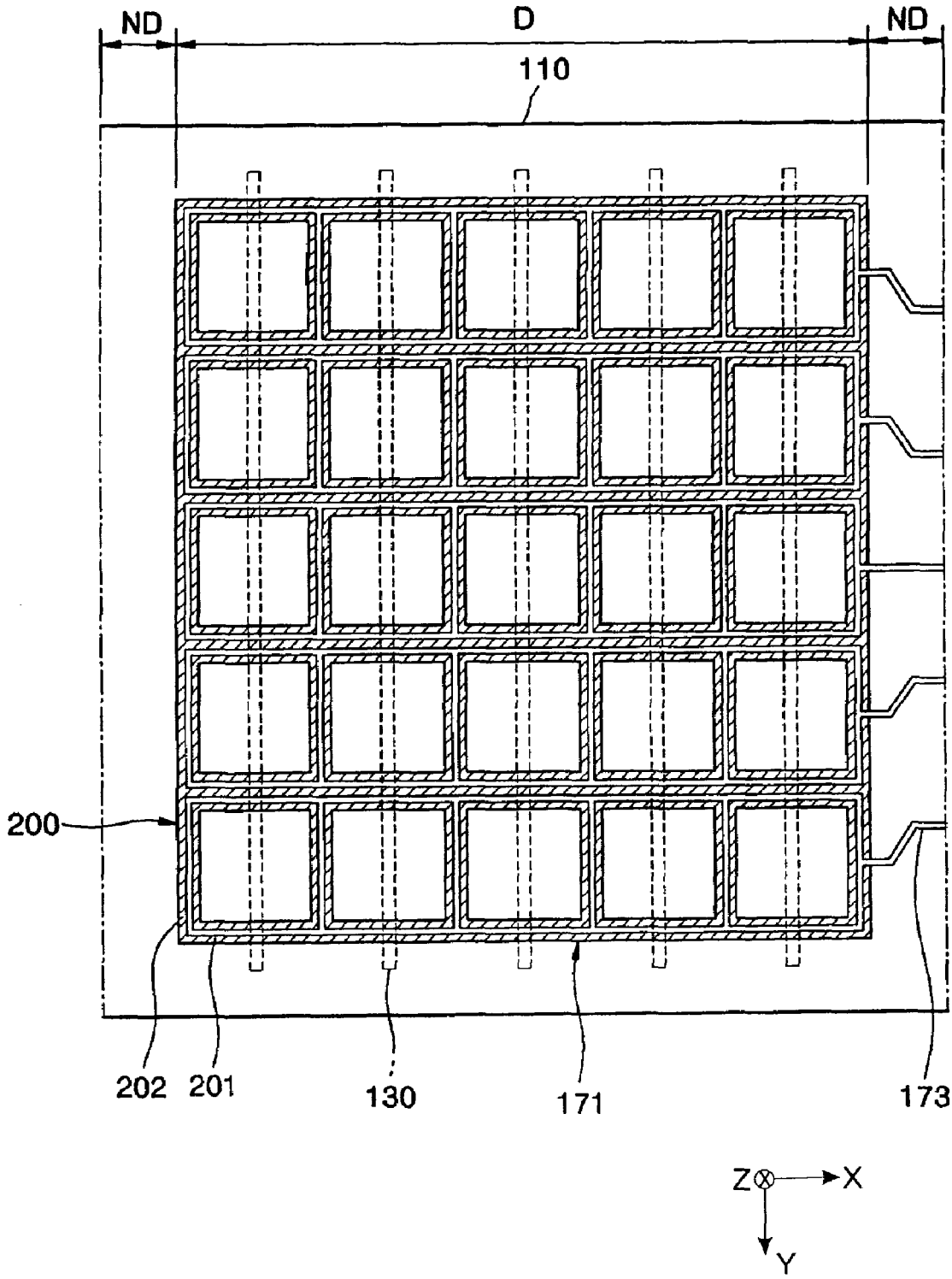
FIG. 4 is a plan view illustrating a first X electrode of the PDP of FIG. 1.
Figure 5:
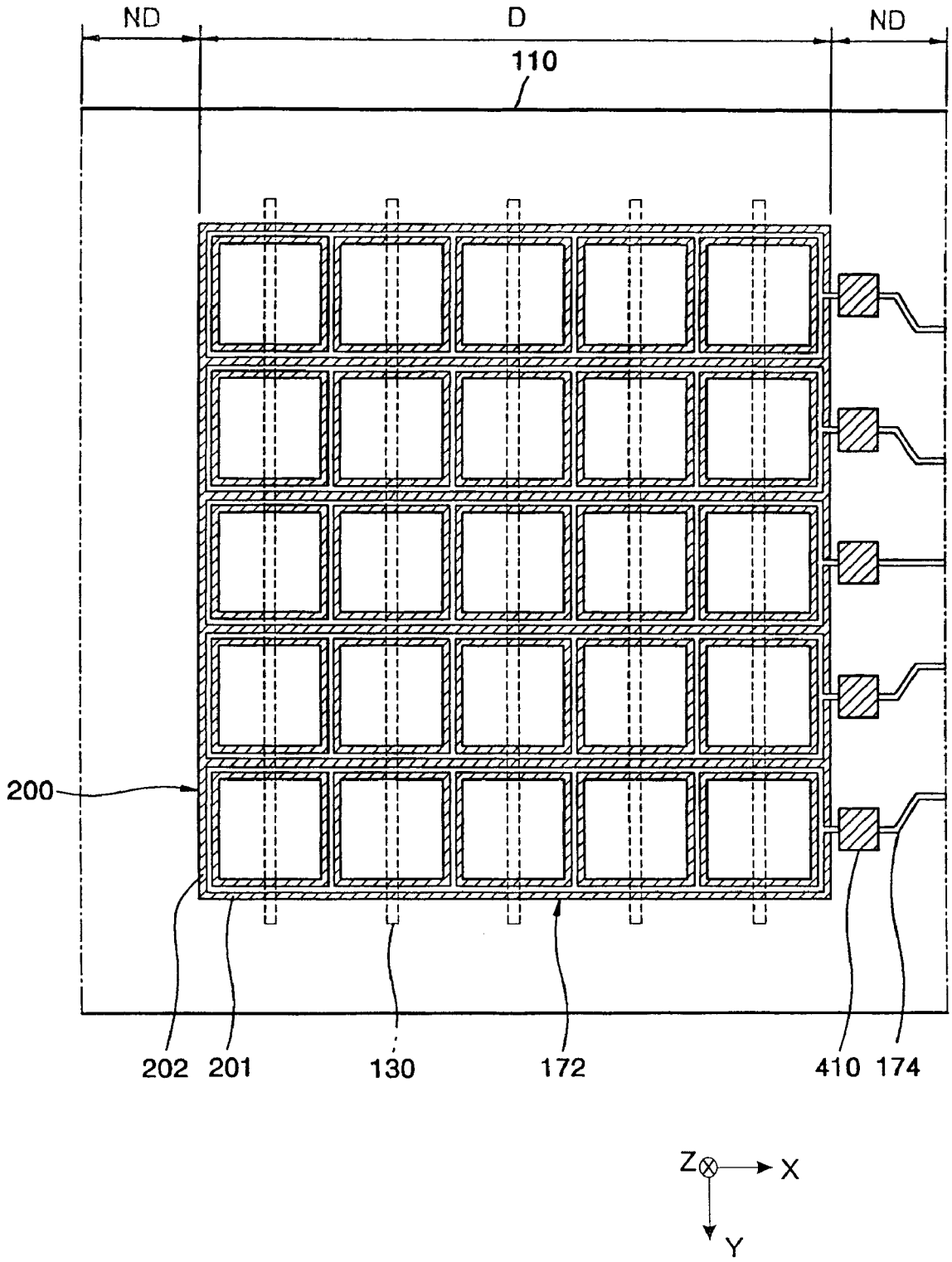
FIG. 5 is a plan view illustrating a second X electrode of the PDP of FIG. 1.

Turning now to FIGS. 4 and 5, FIG. 4 is a plan view illustrating a first X electrode 171 of the PDP 100 of FIG. 1 and FIG. 5 is a plan view illustrating a second X electrode 172 of the PDP 100 of FIG. 1. Referring to FIG. 4, the X electrode 170 is positioned around the discharge cell that is defined by the dielectric grid 200. Also, the X electrode 170 is surrounds consecutive and adjacent discharge cells along the x direction of the PDP 100. The X electrode 170 has a ladder shape along x direction of the PDP 100. A plurality of the ladder-shaped X electrodes 170 are spaced a predetermined distance apart from each other along the y direction of the PDP 100.

The PDP 100 can be divided into a display area D that displays an image and a non-display area ND located at the edges of the PDP 100. In the ND region, the X and Y electrodes are connected to external terminals, such as tape carrier package.

The first X electrode 171 is a ladder shape surrounding individual discharge cells in a rectangular manner within the display area D. A first lead 173 connects to an end of the ladder shaped first X electrode 171 in the non-display area ND. This first lead 173 is electrically connected to an external terminal.

As depicted in FIG. 5, the second X electrode 172 is positioned below the first X electrode 171 (i.e. is positioned in a −z direction from the first X electrode 171). The second X electrode 172 is electrically connected to the first X electrode 171 in the non-display area ND. The second X electrode 172 is also surrounds consecutive and adjacent discharge cells extending in an x direction within display area D. At one end of the PDP 100 in the non-display area ND is a second lead 174 that electrically connects to the second X electrode 172.

A resistive element 410 may be mounted on the second X electrode 172 to control the discharge current. The resistive element 410 is connected to the second X electrode 172 in the non-display area ND. That is, the resistive element 410 is positioned near the edge of the display area D and near where the first and second X electrodes 171 and 172 are connected to each other.

The resistive element 410 is found only on the second X electrode 172 and not on the first X electrode 171. This is because the discharge is initiated between the second X electrode 172 and the first Y electrode 181 and the discharge diffuses to the first X electrode 171 and the second Y electrode 182. It is preferable to position resistive element (s) on the electrodes that are used to initiate the sustain discharge (i.e., the second X electrode 172 and the first Y electrode 181) as opposed to the electrodes not used to initiate the sustain discharge (i.e. the first X electrode 171 and the second Y electrode 182).

The discharge can be initiated and the discharge current can be controlled when the resistive element 410 is present on at least one of the second X electrode 172 and the first Y electrode 181. By designing the PDP 100 according, the present invention reduces the discharge current running through the sustain discharge electrodes while maintaining a discharge voltage.

Figure 6:
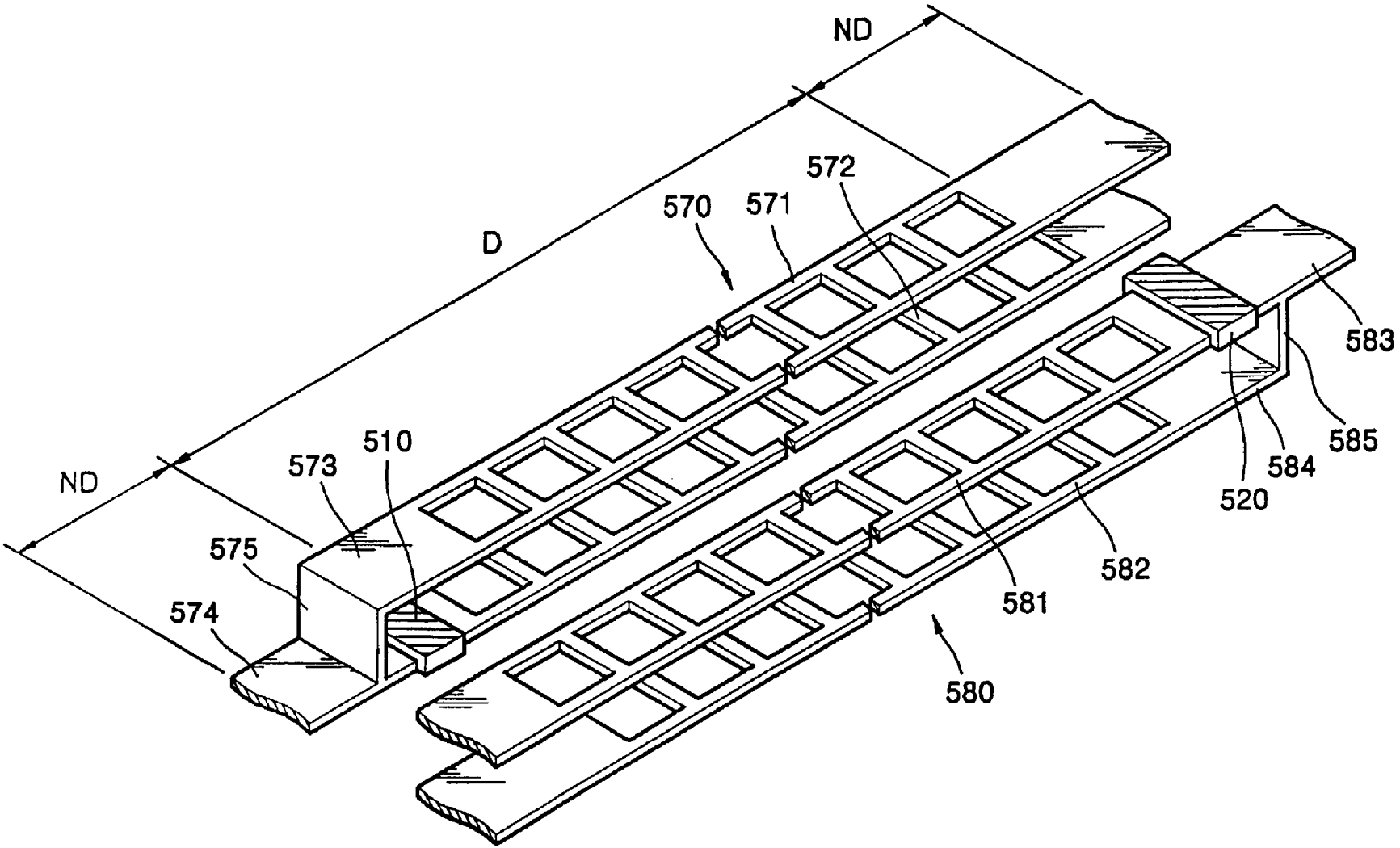
FIG. 6 is a perspective view illustrating X and Y electrodes according to an embodiment of the present invention where a discrete resistive element is used.

Turning now to FIG. 6, FIG. 6 is a perspective view illustrating an X electrode 570 and a Y electrode 580, on which resistive elements are formed, respectively, according to an embodiment of the present invention. Referring to FIG. 6, the X electrode 570 includes a first X electrode 571 and a second X electrode 572 positioned below (i.e., in a −z direction from) the first X electrode 571. A first lead 573 of the first X electrode 571 is electrically connected to a second lead 574 of the second X electrode 572 in the non-display area ND of the display via a first connecting member 575. Also, a first resistive element 510 is positioned on the second X electrode 572 near an edge of the display area D and near the first connecting member 575.

The Y electrode 580 positioned below the X electrode 570 (i.e., closer to the rear substrate and in the −z direction) and is made up of a first Y electrode 581 and a second Y electrode 582 positioned below the first Y electrode 581. A second lead 584 of the second Y electrode 582 is electrically connected to a first lead 583 of the first Y electrode 581 in the non-display area ND via second connecting member 585. Also, a second resistive element 520 is positioned near an edge of the display area D and near the second connecting member 585.

By designing the electrodes this way, the first and second resistive elements 510 and 520 are mounted on the second X electrode 572 and the first Y electrode 581 respectively, and the second X electrode 572 and the first Y electrode 581 are electrically connected to the first X electrode 571 and the second Y electrode 582, respectively.

The X electrode 570 and the Y electrode 580 are made of a material having high conductivity, such as Ag paste, while the first and second resistive elements 510 and 520 may be made of a material having a relatively higher electrical resistivity than that the X and Y electrodes 570 and 580. For example, the first and second resistive elements 510 and 520 can be formed by mixing as Ag paste with a metal powder having high resistivity, such as Co, and/or can be formed by reducing the content of Ag paste from the 60 to 70% content of the X electrode 570 and the Y electrode 580.

Turning now to Table 1 below, Table 1 empirically illustrates characteristics of a PDP when a resistive element is employed in a sustaining electrode pair compared to a control example when no resistive element is present. The inclusion of a resistive element in a sustaining electrode pair is just one of many aspects of the present invention. Table 1 illustrates empirically the advantages of having such a resistive element present in the sustaining electrode pair.

TABLE 1

| | Control Example-electrode with no resistive element | Electrode with resistive element |
|---|---|---|
| Discharge initiation voltage | 260 V | 261 V |
| Brightness (cd/m$^2$) | 215 | 213 |
| Power consumption (W) | 205 | 175 |
| Light emission efficiency (lm/W) | 2.49 | 3.2 |

In the example above in Table 1 according to one aspect of the present invention where a resistive element is present, a resistive element was mounted on X and Y electrodes. In the control (or comparative) example, no resistive element was employed. In addition to the above, the discharge current was determined indirectly from the above power consumption measurements realizing that power equals current times voltage.

Referring to Table 1, in the control example, the measurement result of discharge initiation voltage was 260V, brightness was 215 cd/m$^2$, power consumption was 205 W, and light emission efficiency was 2.49 lm/W. However, when the resistive element is present in the electrodes, the measurement results of discharge initiation voltage was 261 V, brightness was 213 cd/m$^2$, power consumption was 175 W, and light emission efficiency was 3.2 lm/W.

When the results of the control and that of the electrode containing the resistive element are compared, the discharge initiation voltage and the brightness are almost the same. However, the power consumption for the electrode containing the resistive element according to an aspect of the present invention is significantly lower than the power consumption of the control with no resistive element. This difference in power consumption is brought about by the difference in current running through the electrodes since the discharge initiation voltage is essentially identical for both examples. The improvement in the power consumption is approximately 20%. Since power equals the product of current times voltage (P=IV), it can be said that the discharge current can also be improved by the same amount, i.e., 20% by installing a resistive element in the electrodes.

This same result can be reasoned as follows. Since ohms law states that the voltage is resistance times current (V=RI), and since the discharge initiation voltage is the same for both examples but the resistance is higher for the second example than in the control example, the current must be lower in the second example than in the control example in order for the product of resistance times current to equal the same discharge initiation voltage.

Figure 7:
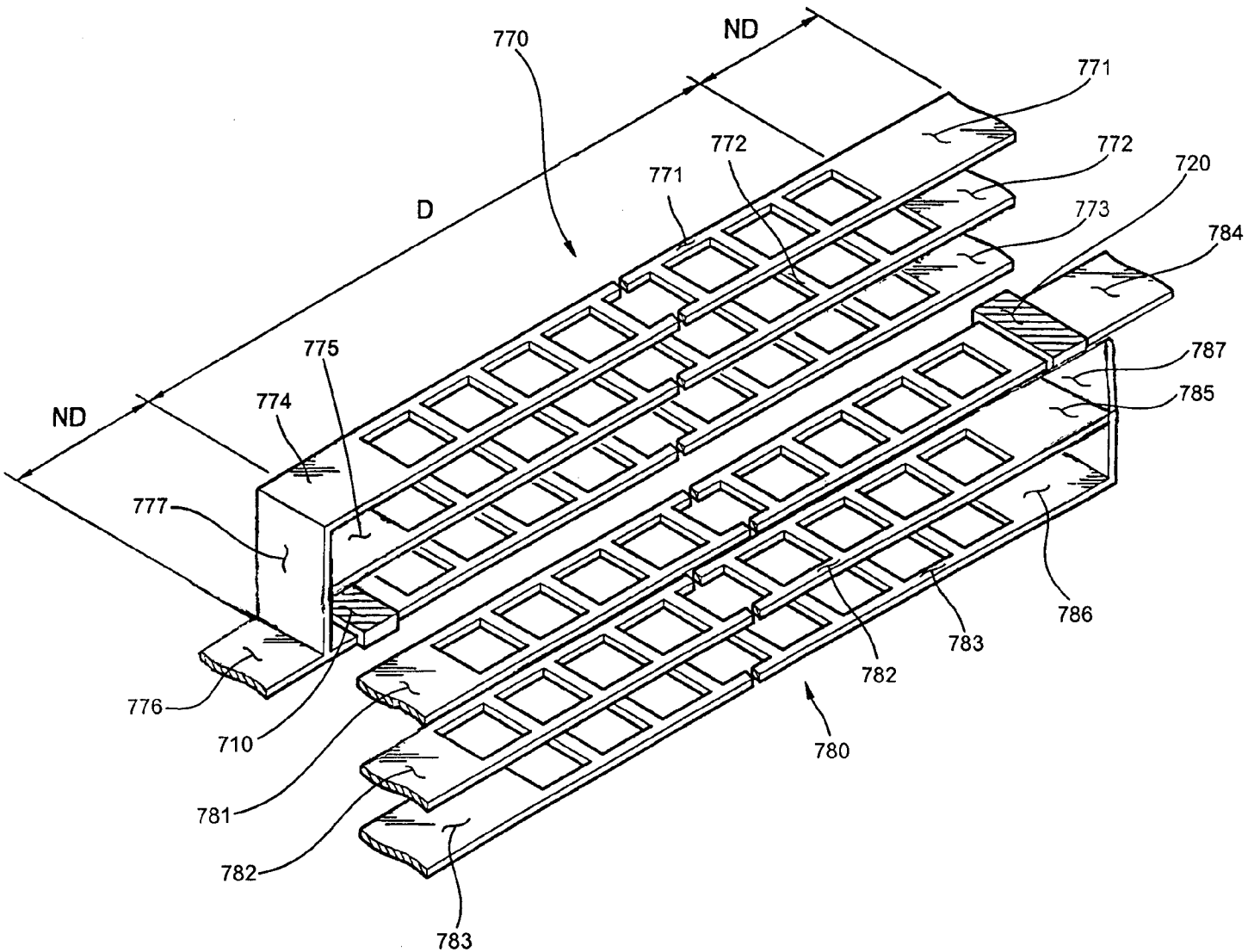
FIG. 7 is a perspective view illustrating X and Y electrodes according to one embodiment of the present invention where each of the X and Y electrodes are made up of three electrodes instead of two electrodes.

Turning now to FIG. 7, FIG. 7 illustrates X electrodes 770 and Y electrodes 780 according to another embodiment of the present invention. Instead of each of the X and Y electrodes having only two electrodes as in FIG. 6, FIG. 7 illustrates each of the X and Y electrodes having three electrodes, X electrode 770 is made up of a first X electrode 771, a second X electrode 772 and a third X electrode 773. Similarly, the Y electrode 780 is made up of a first Y electrode 781, a second Y electrode 782 and a third Y electrode 783.

A first connecting member 777 electrically connects together first lead 774 of first X electrode 771 with second lead 775 of second X electrode 772 with third lead 776 of third X electrode 773. A resistive element 710 is positioned on third X electrode 773 to achieve the desired effect.

A second connecting member 787 electrically connects together first lead 784 of first Y electrode 781 with second lead 785 of second Y electrode 782 with third lead 786 of third Y electrode 783. A resistive element 720 is positioned on third Y electrode 783 to achieve the desired effect.

Although FIG. 7 illustrates each of the X and Y electrodes as containing three electrodes each, other embodiments are also possible and are still within the scope of the present invention. For example, each of the X and Y electrodes can contain 4 electrodes or more, or there can be three X electrodes and four Y electrodes ect.

In the well known equation, the electrical resistance of a resistive element is $R=\rho l/A$ where $\rho$ is the resistivity of the material used, l is the length of the material and A is the cross sectional area of the material. In the embodiment of FIG. 6, a resistive element was added to increase the resistance R of the initiating electrodes. Instead of adding a separate resistive element as in FIG. 6, the entire discharge initiating electrode can be made of a homogeneous material having a higher resistivity ρ than the non resistive electrodes. This embodiment will be discussed in conjunction with FIG. 8.

Figure 8:
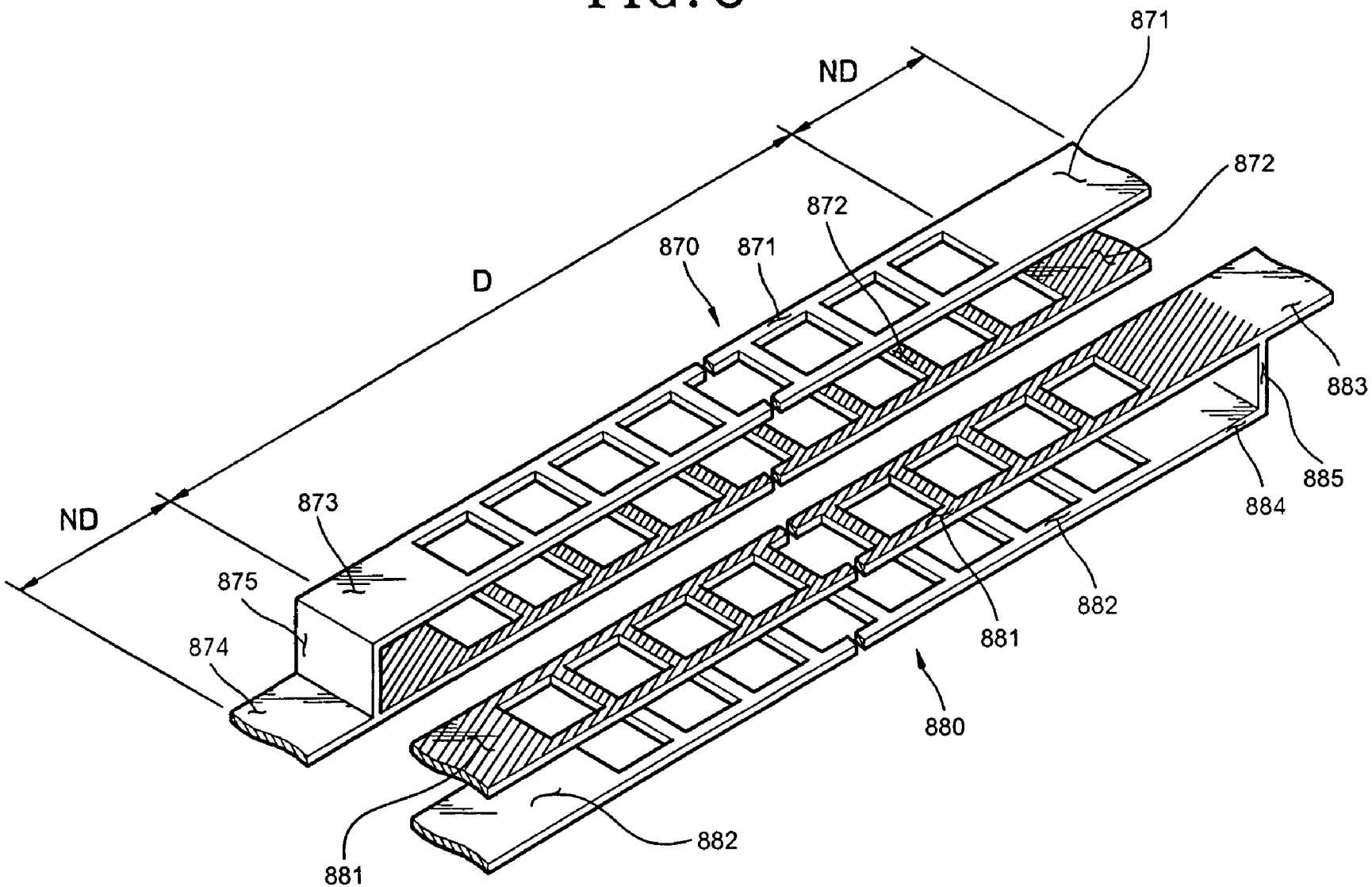
FIG. 8 is a perspective view illustrating X and Y electrodes according to yet another embodiment of the present invention where a distributive resistance is used instead of a discrete resistive element.

Turning now to FIG. 8, FIG. 8 illustrates another embodiment of the present invention. As illustrated in FIG. 8, instead of using a discrete resistive element(s) in the discharge initiating electrode(s), a distributive resistance is instead used. In this embodiment, the entire second X electrode 872 and/or the entire first Y electrode 881 is made of a material having a higher resistivity ρ than the material that makes up the first X electrode 871 and the second Y electrode 882. In the embodiment of FIG. 8, the entire first Y electrode 881 and the entire second X electrode 872 are made of a single homogeneous material having a resistivity slightly higher than the resistivity of the material that makes up the first X electrode 871 and the second Y electrode 882. One example of material that can be used in the distributive resistance material is a mixture of silver paste and a higher resistive element, like cobalt, when forming the first Y electrode 881 and/or the second X electrode 872. Unlike the embodiment illustrated in FIG. 6, the resistive body in the embodiment illustrated in FIG. 8 is not concentrated at one discrete location but is instead continuously distributed evenly throughout the entire length of the second X electrode 872 and/or the first Y electrode 881.

The effect of using distributive resistances as in FIG. 8 has a similar result as in the electrode design in FIG. 6. By increasing the resistance in the first Y electrode 881 and the second X electrode 872, the discharge initiation voltage remains almost unchanged while the power consumption decreases, the decrease being caused by less discharge current compared to when no resistive elements or higher resistivity materials are used.

Again turning to the equation $R=\rho l/A$, it can be seen that other embodiments for electrode designs are possible and still within the scope of the present invention. For example, the discharge initiating electrodes can be made to have a higher resistance by reducing the cross sectional area A compared to the other electrodes. This increases the resistance in the discharge initiating electrodes thus achieving essentially the same desired effect as in FIGS. 6 and 8 of the same discharge initiation voltage with less power and less discharge current. The cross sectional area A of the initiating electrodes can be made smaller by, for example, making the initiating electrodes thinner than the other electrode prongs. This allows the initiating electrodes to maintain their ladder shape and still surround consecutive discharge cells.

It is also to be appreciated that the above embodiments may be mixed in any manner and still be within the scope of the present invention. For example, a combination of using both 1) a thinner material to reduce cross sectional area A and 2) using a higher resistivity material in the initiating electrodes to reduce power consumption and reduce discharge current can be employed. Also, using a higher resistivity material in the initiating electrodes and having 3 or more electrodes for each of the X and Y electrodes can also be used to reduce current and power consumption and still be within the scope of the present invention.

The operation of the PDP 100 will now be described with reference to FIGS. 1 through 5. It is to be understood that the same essential principles also apply to the embodiments of FIGS. 6 through 8. First, a discharge cell for emitting light is selected when a predetermined address voltage is applied between the address electrode 130 and the Y electrode 180. Then, wall charges are accumulated near the Y electrode 180 in the selected discharge cell.

Next, the wall charges are moved by a voltage difference between the X and Y electrodes 170 and 180 when a positive voltage is applied to the X electrode 170 and a higher voltage than the voltage applied to the X electrode 170 is applied to the Y electrode 180.

Plasma is generated by discharges caused by collisions between the moved wall charge and the atoms of the discharge gas that fills the discharge cell. There is a high possibility of initiating the discharge at locations close to the X and Y electrodes 170 and 180 where a relatively strong electric field is formed.

Next, as time passes, the discharge diffuses throughout the entire discharge cell since the electric field formed between the X and Y electrodes 170 and 180 is gradually increased when the large voltage difference of the X and Y electrodes 170 and 180 is maintained. The diffusion rate of the discharge of the present embodiment is significantly improved since the discharge is initiated at the four sides of the discharge cell and diffuses toward the center of the discharge cell.

Also, the amount of plasma generated from the discharge is significantly increased since the plasma generated from the sides of the discharge cell diffuses toward the center of the discharge cell, thus emitting a significantly increased amount of visible light. Accordingly, low voltage driving is realized by utilizing space charges since the plasma diffuses toward the center of the discharge cell from the sides, thus increasing the light emission efficiency.

Moreover, the ion sputtering to the fluorescent layers 160 can be prevented since charges are concentrated at the center of the discharge cell and the electric field caused by the X and Y electrodes 170 and 180 is formed on both sides of the discharge cell.

When the voltage difference between the X and Y electrodes 170 and 180 is reduced after forming the discharge as in the above described manner, no more discharges are generated but the space charges and the wall charges are formed in the discharge cell. When the polarity of the voltages applied to the X and Y electrodes 170 and 180 is inverted, discharge is regenerated with the aid of the wall charges. In this manner, if the polarity of the voltage applied to the X and Y electrodes 170 and 180 is inverted, the discharge process is repeated.

The initiation of the discharge is located essentially between the second X electrode 172 and the first Y electrode 181. When the discharge is initiated, the discharge expands to the first X electrode 171 and the second Y electrode 182.

In this process, plasma rearrangement occurs in the discharge space. Since a resistive element 410 is disposed on the second X electrode 172, discharging can be effectively initiated at a reduced discharge current. After the discharge is initiated, the discharge current of the panel assembly can be reduced while maintaining the discharge voltage by reducing the discharges between the second X electrode 172 and the first Y electrode 181.

As described above, the PDP according to the present invention has the following advantages. By placing the discharge sustaining electrode pairs around the discharge cells and by including at least one resistive element for the discharge sustaining electrode pair, improved results can be realized. First, the light emission efficiency of the panel assembly can be increased since the discharge current can be controlled during discharge. Second, power consumption can be reduced since the discharge current can be reduced. Third, a permanent latent image problem, which is caused by the damage of the fluorescent layer by the ion sputtering, can be prevented by preventing the collision of ions generated from the discharge with the fluorescent layer. Fourth, the discharge surface is significantly increased since the discharge occurs along sides of the discharge space. Fifth, an aperture ratio of the panel is improved since the sustaining electrodes, the dielectric layer, and the protection film are not formed on the inner surface of the front substrate.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A PDP, comprising:

a rear substrate arranged facing a front substrate;

a dielectric grid arranged between the front substrate and the rear substrate and defining discharge cells together with the front substrate and the rear substrate;

an X electrode arranged within the dielectric grid and comprising a first X electrode and a second X electrode arranged separately and around the discharge cell;

a Y electrode arranged within the dielectric grid and comprising a first Y electrode and a second Y electrode arranged separately and around the discharge cell; and a resistive element connected to one of the first X electrode and the second X electrode and another of the first X electrode and the second X electrode being absent of a resistive element.

2. The PDP of claim 1, wherein one of the first Y electrode and the second Y electrode has resistive element and an another of the first Y electrode and the second Y electrode being absent of a resistive element.

3. A PDP, comprising:

a rear substrate arranged facing a front substrate;

a dielectric grid arranged between the front substrate and the rear substrate and defining discharge cells together with the front substrate and the rear substrate;

an X electrode arranged within the dielectric grid and comprising a first X electrode and a second X electrode arranged separately and around the discharge cell, the first X electrode being arranged closer to the front substrate than the second X electrode and the second X electrode being closer to the rear substrate than the first X electrode;

a Y electrode arranged within the dielectric grid and comprising a first Y electrode and a second Y electrode arranged separately and around the discharge cell; and a resistive element connected to at least one of the X and Y electrodes.

4. The PDP of claim 1, the first X electrode being closer to the front substrate than the second X electrode.

5. The PDP of claim 1, the first Y electrode being further from the rear substrate than the second Y electrode, the first Y electrode being further from the front substrate than the second X electrode.

6. The PDP of claim 3, the first Y electrode being arranged closer to the front substrate than the second Y electrode and the second Y electrode being arranged closer to the rear substrate than the first Y electrode.

7. The PDP of claim 4, wherein each of the first Y electrode and the second X electrode comprising a resistive element, wherein the second Y electrode as well as the first X electrode being absent of a resistive element.

8. The PDP of claim 2, wherein the second X electrode is closer to the first Y electrode than the first X electrode, and the first Y electrode is closer to the second X electrode than the second Y electrode.

9. The PDP of claim 1, the resistive element being discrete and not continuous.

10. The PDP of claim 1, the resistive element being a distributed resistive element that is distributed along an entire length of the one of the first X electrode and the second X electrode.

11. The PDP of claim 3, a first resistive element being arranged on the second X electrode and a second resistive element being arranged on the first Y electrode.

12. The PDP of claim 1, the resistive element being arranged at an edge of a display area of the PDP and being arranged near where the first X electrode and the second X electrode are connected to each other.

13. The PDP of claim 2, the resistive element being arranged near an edge of the display area of the PDP and near where the first Y electrode and the second Y electrode are connected to each other.

14. The PDP of claim 1, the X and the Y electrodes are discharge sustaining electrode pairs.

15. The PDP of claim 1, the resistive element comprising a mixture of a material used in the X and Y electrodes and a material having a higher electric resistivity than the material used in the X and Y electrodes.

16. The PDP of claim 15, the X and Y electrodes each comprise Ag paste and the resistive element comprises Ag paste and Cobalt.

17. The PDP of claim 15, the X and Y electrodes each comprise Ag paste and the resistive element comprises Ag paste but at a lower content than in the X and Y electrodes.

18. The PDP of claim 1, further comprising address electrodes arranged on the rear substrate and to form an address discharge with the Y electrode, the address electrodes extending in a direction that crosses the X and Y electrodes for the discharge cell.

19. The PDP of claim 1, the dielectric grid comprises:

a first dielectric grid member arranged in a first direction; and a second dielectric grid member arranged in second and different direction, the second dielectric grid member being arranged as a single integrated monolithic unit with the first dielectric grid member.

20. The PDP of claim 1, further comprising barrier ribs that define the discharge cell together with the dielectric grid, the barrier ribs being arranged between the dielectric grid and the rear substrate, the fluorescent layers being arranged on an inner surface of the barrier ribs.

21. A PDP, comprising:

a rear substrate arranged facing a front substrate;

a dielectric grid arranged between the front substrate and the rear substrate and defining discharge cells together with the front substrate and the rear substrate;

an X electrode arranged within the dielectric grid and comprising at least a first X electrode and a second X electrode arranged separately and around the discharge cell;

a Y electrode arranged within the dielectric grid and comprising at least a first Y electrode and a second Y electrode arranged separately and around the discharge cell; and a resistive element connected to at least one of the X and Y electrodes, the X electrode further comprises a third X electrode arranged separately and around the discharge cell, the Y electrode further comprises a third Y electrode arranged separately and around the discharge cell.

22. The PDP of claim 21, the third X electrode and the first Y electrode each comprising a resistive element, the third X electrode and the first Y electrode each being discharge initiation electrodes.

23. The PDP of claim 22, the third X electrode being closer to the first Y electrode than either of the first and the second X electrodes.

24. The PDP of claim 22, the second X electrode and the second Y electrode each comprising a resistive element.

25. The PDP of claim 22, the resistive elements on the third X electrode and the first Y electrode being discrete.

26. The PDP of claim 25, the first X electrode, the second X electrode, the second Y electrode and the third Y electrode each being absent of a resistive element.

27. A PDP, comprising:

a rear substrate arranged facing a front substrate;

a dielectric grid arranged between the front substrate and the rear substrate and defining discharge cells together with the front substrate and the rear substrate;

an X electrode arranged within the dielectric grid and comprising a first X electrode and a second X electrode arranged separately and around the discharge cell; and a Y electrode arranged within the dielectric grid and comprising a first Y electrode and a second Y electrode arranged separately and around the discharge cell, the second X electrode comprising a material having a higher resistivity than that of the first X electrode.

28. The PDP of claim 27, the first Y electrode being made out of the same material as the second X electrode, the second Y electrode being made out of the same material as that of the first X electrode.

29. The PDP of claim 28, the second X electrode and the first Y electrode each being made out of a homogenous material distributed throughout a length of each of the second X electrode and the first Y electrode.

30. The PDP of claim 28, the second X electrode and the first Y electrode each comprising a homogeneous mixture of silver and cobalt, the first X electrode and the second Y electrode each comprising silver but each being absent of cobalt.

31. The PDP of claim 28, the second X electrode and the first Y electrode being discharge initiating electrodes.

32. The PDP of claim 31, the first Y electrode being closer to the second X electrode than the second Y electrode, the second X electrode being closer to the first Y electrode than the first X electrode.

33. A PDP, comprising:

a rear substrate arranged facing a front substrate;

a dielectric grid arranged between the front substrate and the rear substrate and defining discharge cells together with the front substrate and the rear substrate;

an X electrode arranged within the dielectric grid and comprising a first X electrode and a second X electrode arranged separately and around the discharge cell; and a Y electrode arranged within the dielectric grid and comprising a first Y electrode and a second Y electrode arranged separately and around the discharge cell, a resistance across the first Y electrode being higher than a resistance across the second Y electrode.

34. The PDP of claim 33, the first Y electrode being made of the same material as the second Y electrode, the first Y electrode being thinner than the second Y electrode.

35. The PDP of claim 33, the first Y electrode and the second X electrode being discharge initiation electrodes between which a discharge is initiated.

36. The PDP of claim 33, the first Y electrode being closer to the second X electrode than the second Y electrode.

37. The PDP of claim 35, a resistance across the second X electrode being higher than a resistance across the first X electrode.

38. The PDP of claim 37, the second X electrode being made thinner than the first X electrode but of the same material as the first X electrode.

39. The PDP of claim 37, the second X electrode being made of a material having a higher resistivity than a material that makes up the first X electrode.

* * * * *